US009068411B2

(12) United States Patent
O'Connor et al.

(10) Patent No.: US 9,068,411 B2
(45) Date of Patent: Jun. 30, 2015

(54) THERMAL RELEASE MECHANISM FOR DOWNHOLE TOOLS

(75) Inventors: Keven O'Connor, Houston, TX (US); Basil J. Joseph, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 544 days.

(21) Appl. No.: 13/481,099

(22) Filed: May 25, 2012

(65) Prior Publication Data

US 2013/0312982 A1 Nov. 28, 2013

(51) Int. Cl.
*E21B 23/00* (2006.01)

(52) U.S. Cl.
CPC ..... *E21B 23/00* (2013.01)

(58) Field of Classification Search
CPC ..... E21B 17/06; E21B 17/028; E21B 17/02; E21B 23/00
USPC ..... 166/376, 377, 381, 297, 298, 65.1, 181, 166/323, 55, 242.6, 242.7
See application file for complete search history.

(56) References Cited

U.S. PATENT DOCUMENTS

| | | | | |
|---|---|---|---|---|
| 3,211,232 | A | 10/1965 | Grimmer | |
| 4,178,992 | A | 12/1979 | Regan et al. | |
| 4,194,566 | A | 3/1980 | Maly | |
| 4,314,608 | A | 2/1982 | Richardson | |
| 4,374,543 | A | 2/1983 | Richardson | |
| 4,379,722 | A | 4/1983 | Scott | |
| 4,390,065 | A | 6/1983 | Richardson | |
| 4,570,715 | A * | 2/1986 | Van Meurs et al. | 166/302 |
| 4,621,987 | A | 11/1986 | Spingath, Jr. | |
| 4,705,118 | A | 11/1987 | Ennis | |
| 4,771,831 | A | 9/1988 | Pringle et al. | |
| 5,046,557 | A | 9/1991 | Manderscheid | |
| 5,199,497 | A | 4/1993 | Ross | |
| 5,238,070 | A | 8/1993 | Schultz et al. | |
| 5,398,998 | A | 3/1995 | Evans | |
| 5,425,424 | A | 6/1995 | Reinhardt et al. | |
| 5,441,111 | A | 8/1995 | Whiteford | |
| 5,479,986 | A | 1/1996 | Gano et al. | |

(Continued)

FOREIGN PATENT DOCUMENTS

| | | |
|---|---|---|
| EP | 0518371 B1 | 6/1992 |
| EP | 0518371 A3 | 12/1992 |
| EP | 0999337 B1 | 2/2006 |

OTHER PUBLICATIONS

International Search Report & Written Opinion dated Aug. 27, 2013 issued in PCT/US2013/042859.

(Continued)

*Primary Examiner* — Kenneth L Thompson
*Assistant Examiner* — Michael Wills, III
(74) *Attorney, Agent, or Firm* — Parsons Behle & Latimer

(57) ABSTRACT

A release mechanism for use in setting a downhole tool comprises two connectors releasably connected to one other. One of the connectors includes a material having a coefficient of thermal expansion that is different from a material included in the second connector. The difference in the coefficients of thermal expansion causes one of the connectors to expand greater than the other connector when heat is applied to one or both of the connectors. As a result of the greater expansion of one of the connectors, the connectors release from each other. Upon release, an actuator within the downhole tool is permitted to move and cause actuation or setting of the downhole tool.

17 Claims, 4 Drawing Sheets

(56) References Cited

U.S. PATENT DOCUMENTS

| | | | | |
|---|---|---|---|---|
| 5,664,629 | A | 9/1997 | Maitland | |
| 5,685,372 | A | 11/1997 | Gano | |
| 5,709,269 | A | 1/1998 | Head | |
| 5,752,814 | A | 5/1998 | Starks et al. | |
| 5,765,641 | A | 6/1998 | Shy et al. | |
| 5,992,289 | A | 11/1999 | George et al. | |
| 6,026,903 | A | 2/2000 | Shy et al. | |
| 6,032,733 | A * | 3/2000 | Ludwig et al. | 166/60 |
| 6,076,600 | A | 6/2000 | Vick, Jr. et al. | |
| 6,142,227 | A | 11/2000 | Hiorth et al. | |
| 6,155,350 | A | 12/2000 | Melenyzer | |
| 6,161,622 | A | 12/2000 | Robb et al. | |
| 6,189,618 | B1 | 2/2001 | Beeman et al. | |
| 6,220,350 | B1 | 4/2001 | Brothers et al. | |
| 6,279,656 | B1 | 8/2001 | Sinclair et al. | |
| 6,382,234 | B1 | 5/2002 | Birckhead et al. | |
| 6,427,778 | B1 | 8/2002 | Beall et al. | |
| 6,431,269 | B1 * | 8/2002 | Post et al. | 166/65.1 |
| 6,431,276 | B1 | 8/2002 | Robb et al. | |
| 6,779,600 | B2 | 8/2004 | King et al. | |
| 6,904,975 | B2 | 6/2005 | Horne et al. | |
| 6,923,263 | B2 | 8/2005 | Eden et al. | |
| 7,389,821 | B2 | 6/2008 | Xu | |
| 7,552,777 | B2 | 6/2009 | Murray et al. | |
| 7,562,712 | B2 | 7/2009 | Cho et al. | |
| 7,726,406 | B2 | 6/2010 | Xu | |
| 7,730,954 | B2 | 6/2010 | Schultz et al. | |
| 7,793,733 | B2 | 9/2010 | Stewart | |
| 7,819,198 | B2 | 10/2010 | Birckhead et al. | |
| 7,832,474 | B2 * | 11/2010 | Nguy | 166/242.6 |
| 7,992,638 | B2 | 8/2011 | Benton et al. | |
| 2002/0088616 | A1 | 7/2002 | Swor et al. | |
| 2003/0037921 | A1 | 2/2003 | Goodson, Jr. | |
| 2003/0094285 | A1 | 5/2003 | French | |
| 2004/0040710 | A1 | 3/2004 | Eden et al. | |
| 2004/0251025 | A1 | 12/2004 | Giroux et al. | |
| 2005/0092363 | A1 | 5/2005 | Richard et al. | |
| 2005/0092484 | A1 | 5/2005 | Evans | |
| 2005/0161224 | A1 | 7/2005 | Starr et al. | |
| 2005/0205264 | A1 | 9/2005 | Starr et al. | |
| 2005/0241855 | A1 | 11/2005 | Wylie et al. | |
| 2006/0005968 | A1 | 1/2006 | Vinegar et al. | |
| 2006/0076149 | A1 | 4/2006 | McCalvin | |
| 2006/0131031 | A1 | 6/2006 | McKeachnie et al. | |
| 2007/0125532 | A1 | 6/2007 | Murray et al. | |
| 2008/0066923 | A1 | 3/2008 | Xu | |
| 2008/0110615 | A1 | 5/2008 | Xu | |
| 2008/0236840 | A1 | 10/2008 | Nguy | |
| 2009/0205833 | A1 | 8/2009 | Bunnell et al. | |
| 2010/0051284 | A1 | 3/2010 | Stewart | |
| 2010/0307764 | A1 * | 12/2010 | Buckle | 166/372 |
| 2011/0174504 | A1 | 7/2011 | Wright et al. | |
| 2012/0043073 | A1 | 2/2012 | Bishop et al. | |

OTHER PUBLICATIONS

Baker Hughes Incorporated. Model "E" Hydro-Trip Pressure Sub, Product Family No. H79928, Sep. 25, 2003, pp. 1-4, Baker Hughes Incorporated, Houston, Texas USA.

Innicor Completion Systems, HydroTrip Plug Sub, Product No. 658 0000, Jul. 26, 2004, p. 1, Innicor Completion Systems, Canada.

I.C. Chapman, et al., Wireline Deployed Metal Sealing Bridge Plug System: Operational Learning Curve and Subsequent Redevelopment, SPE 113891, Apr. 1, 2008, pp. 1-13, Society of Petroleum Engineers, The Woodlands, Texas, U.S.A.

* cited by examiner

THERMAL RELEASE MECHANISM FOR DOWNHOLE TOOLS

BACKGROUND

1. Field of Invention

The invention is directed to release mechanisms for use in the actuation of downhole tools and, in particular, thermal release mechanisms that initially retain an actuator in a run-in position until a predetermined temperature is reached, at which time the release mechanism releases the actuator to actuate the downhole tool.

2. Description of Art

Some downhole tools need to be retained in an unset position until properly placed in the well. It is only when they are properly located within the well that the downhole tool is set through actuation of either the downhole tool itself or an actuator device that mechanically moves the downhole tool to its set position. One prior technique for actuating downhole tools is creation of a window or passageway within the downhole tool or actuating device exposing the actuating member, e.g., piston, of the downhole tool or actuating device to the wellbore environment, e.g., the hydrostatic wellbore pressure. The hydrostatic pressure then acts upon the actuating member of the downhole tool to move the actuating member and, thus, the downhole tool, to the set position so that the downhole tool is actuated. In this technique, the creation of the window or passageway does not directly actuate the downhole tool.

In other downhole tools or actuating devices, a fluid pumped down the well is used to break shear pins on the downhole tools which release the actuating member so that the downhole tool is moved to its set position. In still other downhole tools or actuating devices, an explosive charge is detonated by a detonator connected to the surface of the well through an electronic line or connected to battery pack located on the downhole tool or actuating device. The force from the combustion of the explosive charge then acts upon the actuating member and the downhole tool is either directly, or indirectly through the actuating device, actuated.

SUMMARY OF INVENTION

Broadly, the release mechanism, or trigger, for downhole tools comprises a pair of connectors releasably secured to each other. One of the connectors comprises a first material having a first coefficient of thermal expansion and the other connection comprises a second material having a second coefficient of thermal expansion that is different from the first coefficient of thermal expansion. The difference in coefficient of thermal expansion of the two materials causes one of the connectors to experience greater expansion as compared to the other connector when heat is applied to one or both of the connectors. As a result of the expansion of the connector having the higher coefficient of thermal expansion, the secured pair of connectors are released from each other, thereby releasing an actuator previously retained by the release mechanism. Release of the actuator permits the actuator to move which causes the downhole tool to be set or actuated.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
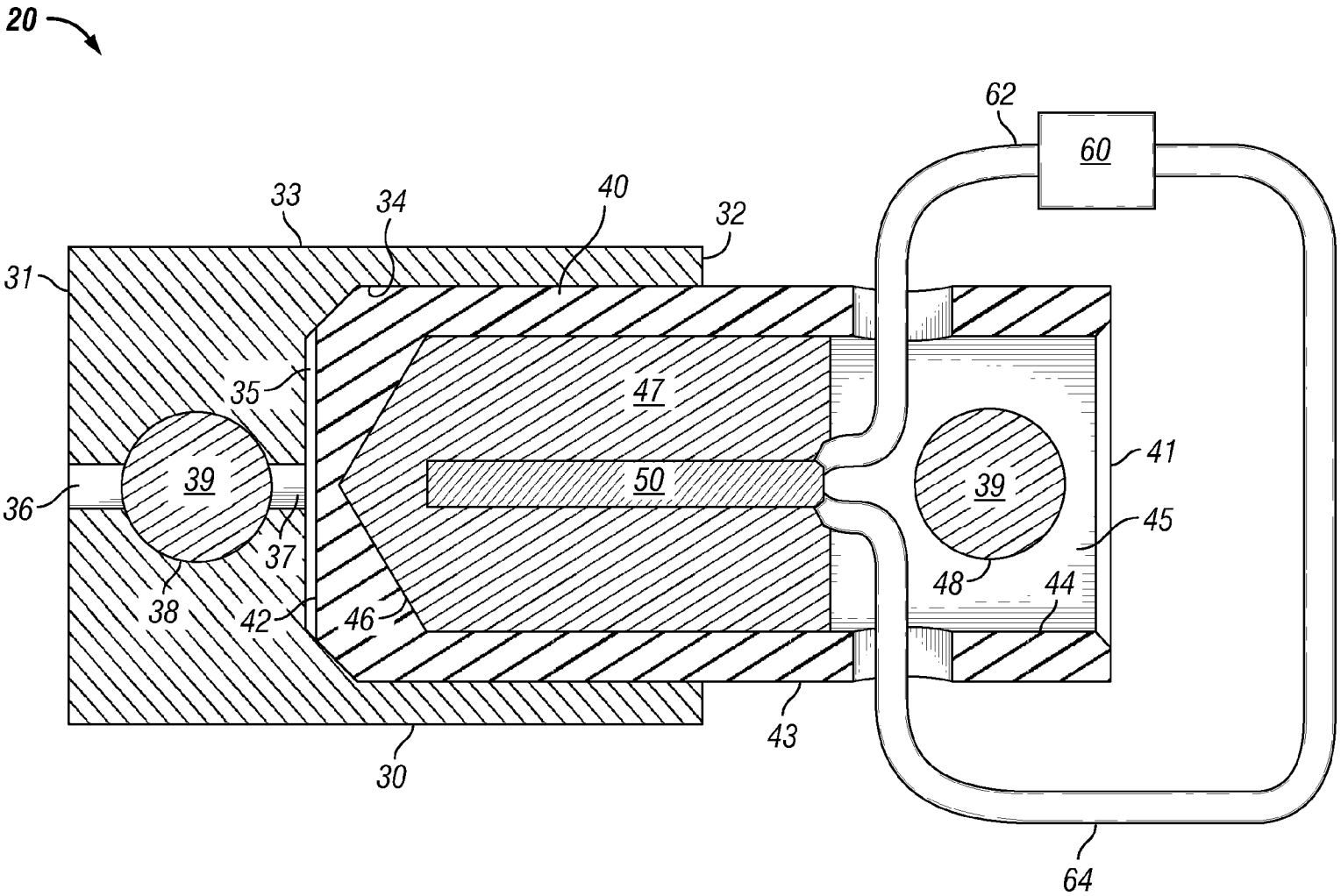
FIG. 1 is a cross-sectional view of one specific embodiment of a release mechanism shown in the secured position.
Figure 2:
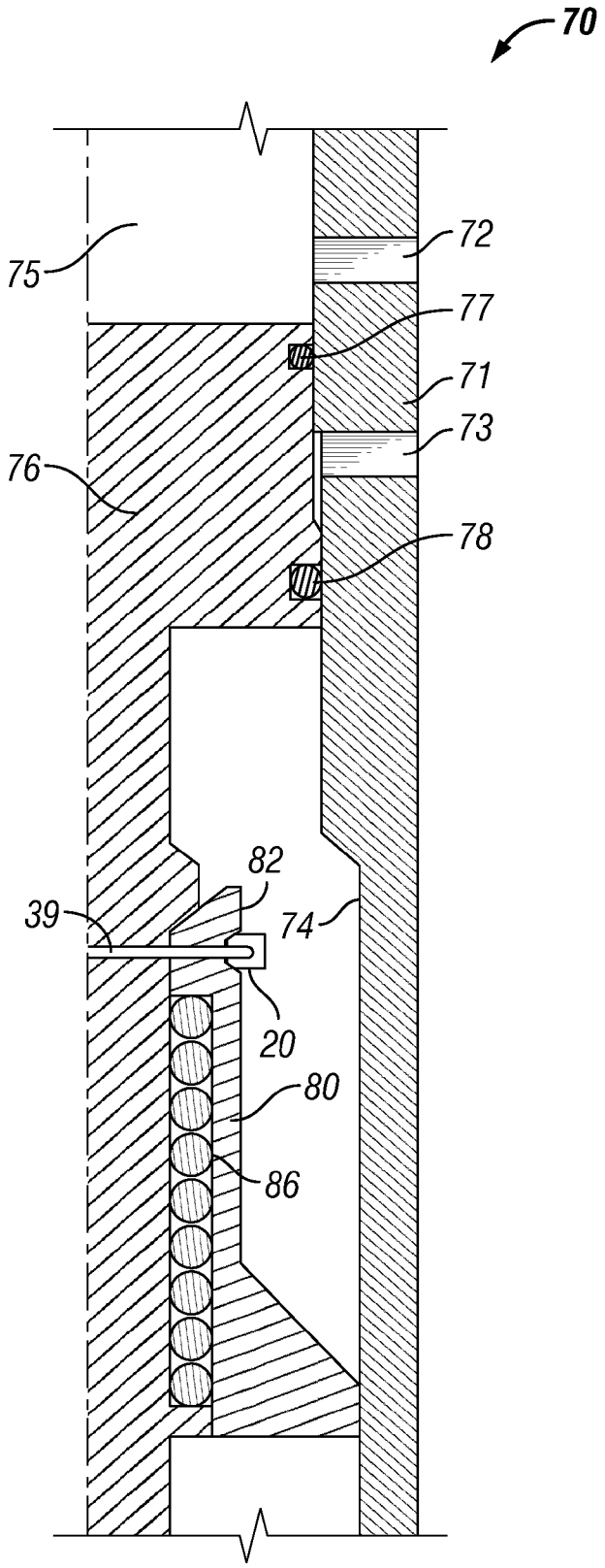
FIG. 2 is a partial cross-sectional view of a downhole tool having the release mechanism of FIG. 1, the downhole tool shown in the downhole tool run-in position.
Figure 3:
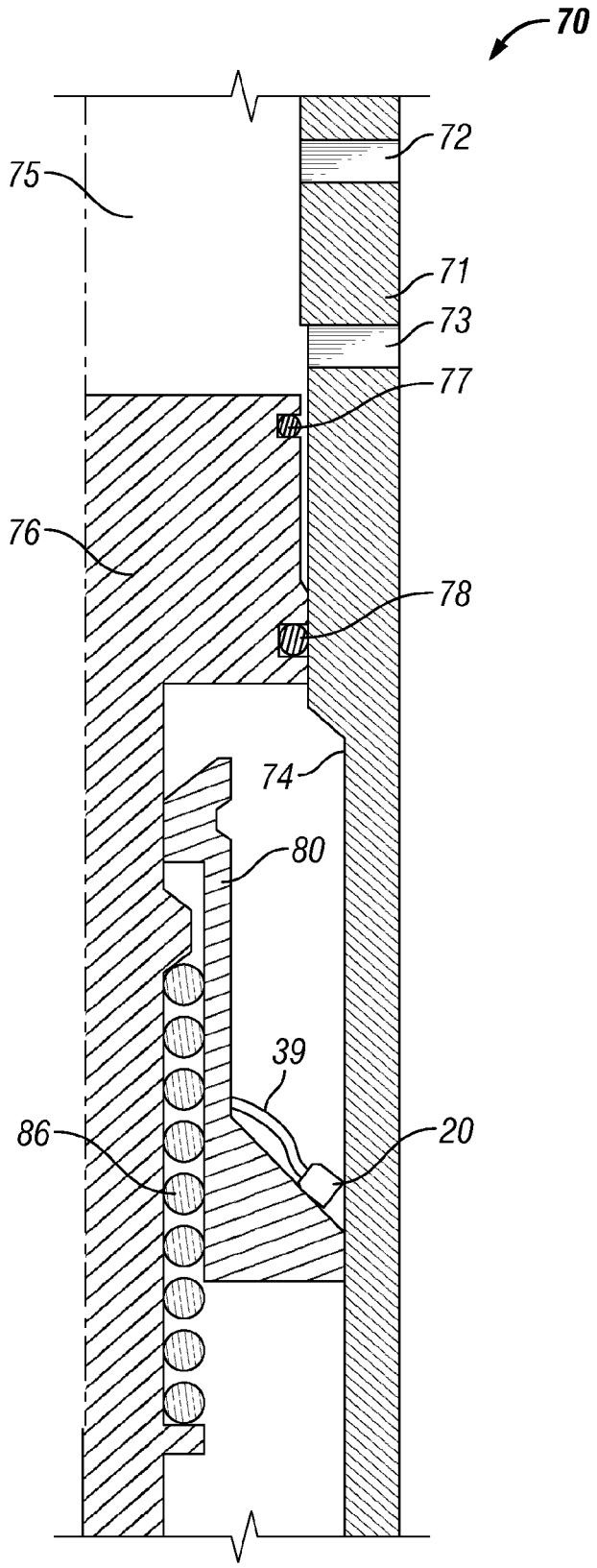
FIG. 3 is a cross-sectional view of the downhole tool of FIG. 2 having the release mechanism of FIG. 1, the downhole tool shown in the downhole tool actuated position.

Referring now to FIGS. 1-3, in one specific embodiment, release mechanism 20 comprises first connector 30, second connector 40, heating element 50, and power source 60. In the embodiment of FIGS. 1-3, first connector 30 is shown as a sleeve having first end 31, second end 32, outer wall surface 33, and inner wall surface 34 defining sleeve bore 35. As shown in FIG. 1, upper end 36 of sleeve bore 35 is partially closed having weep hole 37. Weep hole 37 allows fluid to flow out of sleeve bore 35 during connection of first connector 30 to second connector 40. Thus, weep hole 37 facilitates connection of first and second connectors 30, 40 to each other.

In the embodiment of FIG. 1-3, first connector 30 also includes a fastener member shown as hole 38. Hole 38 facilitates connecting first connector 30 with second connection 40 such as through connector tension element 39 securing first end 31 of first connector 30 to first end 41 of second connector 40. Connector tension element 39 places first and second connectors 30, 40 under tensile forces biasing or urging first and second connectors 30, 40 toward the released position. In other words, connector tension element 39 attempts to pull apart the connection between first and second connectors 30, 40. Connector tension element 39 can comprise a band, a single wire, a braid of a plurality of wires, and the like. In certain embodiments, connector tension element 39 comprises a metal band, or one or more metal wires.

In the embodiment of FIGS. 1-3, second connector 40 is shown as a pin having first end 41, second end 42, outer wall surface 43, and inner wall surface 44 defining cavity 45 having first cavity end 46 which is closed off. Disposed within cavity 45 is potting material 47. In one embodiment, potting material 47 has a high thermal conductivity. Suitable potting materials 47 include high temperature solders such as those containing copper and silver, and high temperature brazen materials.

Disposed within potting material 47 is heating element 50. Heating element 50 is operatively associated with power source 60 through wires 62, 64. In one particular embodiment, heating element 50 is an electrically powered device, e.g., an electronic resistor heating element, that generates heat when electricity passes through it and, therefore, power source is an electricity generator, such as a battery that is disposed in close proximity to release mechanism 20. In other embodiments, the electricity flowing through heating element 50 originates from another source, whether within a downhole tool string or from the surface of the well. In one embodiment, heating element 50 is operatively associated with power source 60 by wires 62, 64 being connected to a switch on a circuit board. Upon activation of the switch, electricity flows to heating element 50 which heats up first and second connectors 30, 40 and potting material 47.

In the embodiment of FIGS. 1-3, first and second connectors 30, 40 have a secured position (FIG. 1) defined by an interference fit between inner wall surface 34 of first connector 30 and outer wall surface 43 of second connector 40. The interference fit can be established by using a hydraulic press to insert second connector 40 into sleeve bore 35. Alternatively, first and second connectors 30, 40 can be heated up to the firing temperature, e.g., 800° F., of the materials forming first and second connector 30, 40 and then second connector 40 inserted into sleeve bore 35. Upon cooling, the interference fit will be established to provide a very high surface contact force and, thus, a high friction force. The interference fit allows the connection between first and second connectors 30, 40 to hold a high tensile load when at nominal temperatures, e.g., below 400° F.

First connector 30 comprises a first material having a first coefficient of thermal expansion. Second connector 40 comprises a second material having a second coefficient of thermal expansion. The first coefficient of thermal expansion and the second coefficient of thermal expansion are different. Thus, when heat is applied to both first connector 30 and second connector 40, one of the connectors will expand to a greater extent than the other connector. This greater expansion of one of the connectors permits first connector 30 and second connector 40 to be released from their secured position (FIG. 1). In so doing, an actuator, such as piston 76 discussed in greater detail with respect to FIGS. 2-3, is released so that piston 76 can move and, thus, actuate a downhole tool.

In the embodiment of FIGS. 1-3, the first material of first connector 30 has a coefficient of thermal expansion that is greater than the coefficient of thermal expansion of the second material comprising second connector 40. Accordingly, upon powering-up of heating element 50 by flowing electricity from power source 60 through heating element 50, first connector 30 increases in diameter more than second connector 40. As a result, outer wall surface 43 of second connector 40 is permitted to move out of sleeve bore 35 toward a released position. The released position is defined as the point at which first connector 30 and second connector 40 have sufficiently moved relative to each other such that the actuator of a downhole tool is no longer retained by release mechanism 20. Thus, the released position can be when first and second connectors 30, 40 are no longer touching one another; or the released position can be at any point during movement of first connector 30 away from second connector 40. Accordingly, in certain embodiments of release mechanism 20 shown in FIG. 1, the released position can be when second connector 40 has moved completely out of sleeve bore 45, or at any point along the line of travel of second connector 40 out of sleeve bore 45.

Referring now to FIGS. 2-3, downhole tool 70 comprises mandrel 71 having upper port 72, lower port 73, and inner wall surface 74 defining bore 75. Disposed in bore 75 and partially in sliding engagement with inner wall surface 74 is an actuator shown as piston 76. Piston 76 includes upper and lower seals 77, 78. As shown in FIGS. 2-3, upper seal 77 is smaller than lower seal 78, thus creating a downward bias on piston 76, i.e., urging piston 76 toward the actuated position.

Piston 76 initially blocks lower port 73. Piston 76 is maintained in the run-in position (FIG. 2) by release mechanism 20 disposed along outer wall surface 82 of collet 80. Collet 80 is secured to mandrel 71 through any method or device known in the art. For example, collet 80 may be secured to inner wall surface 74 by threads (not shown). Alternatively, collet 80 may be secured to mandrel 71 by a fastener such as a cap screw installed through a flange portion of collet 80 extending through mandrel 71.

Spring 86 is disposed within a chamber formed by piston 76 and collet 80. Spring 86 is biased downward thereby urging piston 76 toward the actuated position (FIG. 3).

In operation, of downhole tool 70 and, thus, release mechanism 20, downhole tool 70 is placed within a downhole tool string (not shown). The downhole tool string is then run to depth, i.e., located, within a well (not shown) at the location at which the downhole tool is to be actuated. As the downhole tool string is lowered into the well, hydrostatic pressure (not shown) within the well flows through port 72 to act on the upper surface of piston 76. In addition, the downward bias by upper seal 77 being smaller than lower seal 78 and by spring 86 try to push piston 76 downward. Piston 76, however, is restricted from movement by collet 80 and release mechanism 20. Upon reaching the desired location within the well, power source 60 is activated causing electricity to flow through heating element 50. In so doing, heating element generates heat that is conducted through potting material 47, the second material of second connector 40, and the first material of first connector 30. As the temperature increases, the first material of first connector 30 expands at a faster rate than expansion of the second material of second connector 40 because the first material has a higher coefficient of thermal expansion compared to the coefficient of thermal expansion of the second material. As a result, the forces providing the interference fit between outer wall surface 43 of second connector 40 and inner wall surface 34 of first connector 30 are lessened which allows second connector 40 to move out of sleeve bore 45. In so doing, first and second connectors 30, 40 move toward the released position at which time piston 76 is permitted to move to actuate the downhole tool (FIG. 3 showing the actuated position).

Although the temperature required to release the connection between first and second connectors 30, 40 (the "firing temperature") is approximately 800° F., the low mass of release mechanism 20 permits the firing temperature to be reached fairly quickly using existing batteries and normal circuitry.

In one particular embodiment, connector tension element 39 connects first connector 30 with second connector 40 and, in so doing, provides pre-existing tensile forces that pulls first and second connectors 30, 40 toward the released position. Thus, as the interference fit between first and second connectors is lessened due to the thermal expansion differential between first connector 30 and second connector 40, the pre-existing tensile forces provided by connector tension element 39 urges first and second connectors 30, 40 toward the release position.

Figure 4:
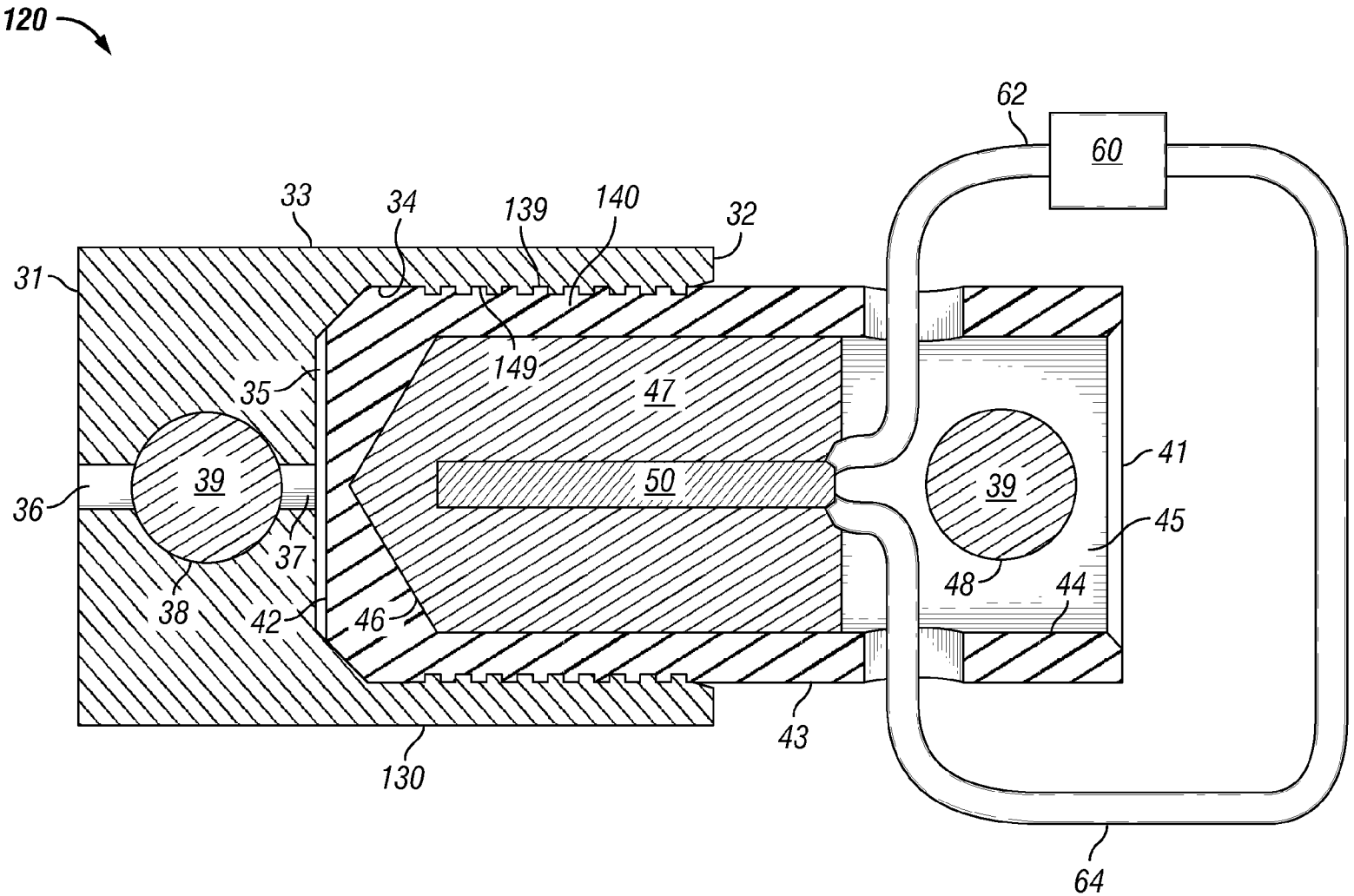
FIG. 4 is a cross-sectional view of another specific embodiment of a release mechanism shown in the secured position.

Referring now to FIG. 4, in another particular embodiment, release mechanism 120 includes first connector 130 and second connector 140. FIG. 4 shows release mechanism 120 in the secured position. With the exception of the profiles discussed herein, first connector 130 and second connector 140 are identical to first connector 30 and second connector 40, respectively, of the embodiments of FIGS. 1-3.

To facilitate retaining first and second connectors 130, 140 in the retained position, outer wall surface 43 of second connector 140 and inner wall surface 34 of first connector 130 are reciprocally-profiled to engage one another such as through profiles comprising threads or breechblock connectors. The addition of profiles 139, 149 to outer wall surface 43 of second connector 140 and inner wall surface 34 of first connector 130, respectively, allows greater tensile forces to be applied to first and second connectors 130, 140 without first and second connectors 130, 140 being moved toward the released position. As a result, greater loads can be applied to release mechanism 120 without release mechanism prematurely releasing the actuator of the downhole tool.

Operation of release mechanism 120 is similar to the operation of release mechanism 20 of FIGS. 1-3 with the exception that first connector 120 and second connector 130 must expand further to overcome the profiled connection between first connector 120 and second connector 130.

As will be understood by persons skilled in the art, the first material and the second material can be any desired or necessary materials that provide the appropriate difference in coefficients of thermal expansion so that first and second connectors 30, 40, 130, 140 can move from the secured position to the released position. Suitable materials include aluminum, steel, and INVAR, magnesium, carbon, ceramic materials, and mixtures and combinations thereof. In one specific embodiment, the first material comprises aluminum and the second material comprises steel.

It is to be understood that the invention is not limited to the exact details of construction, operation, exact materials, or embodiments shown and described, as modifications and equivalents will be apparent to one skilled in the art. For example, the release mechanisms disclosed herein can be used to open a valve, close a valve, release a ball, release slips, dogs, or c-rings to allow axial movement which may initiate further downhole operations, or any other operation known in the art. Further, actuation of the downhole tool after moving the release mechanism to the released position may be performed by hydrostatic pressure acting on the actuator, through the release of stored energy, such as allowing a spring to expand, or through any other method or device known in the art. In addition, the profiles on the interlocking, or reciprocal, profiles on the outer wall surface of one connector and the inner wall surface of another connector can be any profiles that, when heated, allow the connectors to move to the released position and provide acceptable tensile strength to prevent activation of the release mechanism prematurely. Accordingly, the invention is therefore to be limited only by the scope of the appended claims.

What is claimed is:

1. A release mechanism for actuating a downhole tool, the release mechanism comprising:

a first connector having a first material, the first material having a first coefficient of thermal expansion;

a second connector having a second material, the second material having a second coefficient of thermal expansion, the second coefficient of thermal expansion being different from the first coefficient of thermal expansion, and the second connector being releasably connected to the first connector;

a connector tension element securing a first end of the first connector to a first end of the second connector;

a heating element operatively associated with at least one of the first material or the second material; and a power source operatively associated with the heating element, wherein the first connector and the second connector have a secured position relative to each other and a released position relative to each other, and wherein activation of the heating element causes the first connector and the second connector to be move toward the released position.

2. The release mechanism of claim 1, wherein the first connector comprises a sleeve and the second connector comprises a pin, the pin being disposed within the sleeve when the sleeve and the pin are disposed in the secured position relative to each other.

3. The release mechanism of claim 2, wherein the pin and the sleeve comprise an interference fit when the sleeve and the pin are disposed in the secured position relative to each other.

4. The release mechanism of claim 2, wherein an outer wall surface of the pin includes a pin profile and an inner wall surface of sleeve includes a sleeve profile reciprocally-shaped relative to the pin profile to facilitate securing the pin with the sleeve in the secured position.

5. The release mechanism of claim 2, wherein the sleeve comprises a partially closed first end for at least partial engagement with a first end of the pin.

6. The release mechanism of claim 5, wherein a weep hole is disposed through the sleeve and is in fluid communication with a sleeve bore into which the pin is disposed when the sleeve and pin are disposed in the secured position.

7. The release mechanism of claim 1, wherein the connector tension element comprises a band disposed thorough a first hole in the first end of the first connector and through a first hole in the first end of the second connector.

8. The release mechanism of claim 7, wherein the band comprises a metal wire.

9. A downhole tool, comprising:

a release mechanism, the release mechanism having a first connector having a first material, the first material having a first coefficient of thermal expansion, a second connector having a second material, the second material having a second coefficient of thermal expansion, the second coefficient of thermal expansion being less than the first coefficient of thermal expansion, and the second connector being releasably connected to the first connector, wherein the first connector and the second connector have a secured position relative to each other and a released position relative to each other, and a heating element operatively associated with at least one of the first material or the second material, wherein activation of the heating element causes the first connector and the second connector to be move toward the released position; and an actuator operatively associated with the release mechanism, the actuator having a run-in position when the release mechanism is in the secured position and an actuated position when the release mechanism is in the released position, wherein the actuator comprises a piston connected to a collet via the release mechanism when the actuator is diposed in the run-in position, and the release mechanism being disposed along an outer wall surface of the collet.

10. The release mechanism of claim 9, wherein the first connector comprises a sleeve and the second connector comprises a pin, the pin being disposed within the sleeve when the sleeve and the pin are disposed in the secured position relative to each other.

11. The release mechanism of claim 10, wherein the pin is disposed outside of the sleeve when the sleeve and the pin are disposed in the released position relative to each other.

12. The downhole tool of claim 10, wherein the heating element is disposed within the pin.

13. A method comprising the steps of:

(a) running a downhole tool into a well, the downhole tool having a release mechanism, the release mechanism having a first connector having a first material, the first material having a first coefficient of thermal expansion, a second connector having a second material, the second material having a second coefficient of thermal expansion, the second coefficient of thermal expansion being different from the first coefficient of thermal expansion, the first connector and the second connector having a secured position relative to each other and a released position relative to each other, a heating element operatively associated with at least one of the first material or the second material, and an actuator operatively associated with the release mechanism, the actuator having a run-in position when the release mechanism is in the secured position and an actuated position when the release mechanism is in the released position;

(b) activating the heating element causing expansion of the first connector and, thus, movement of the first connector and the second connector toward the released position, wherein during step (b), a connector tension element secured to the first and second connector urges the first and second connectors from the secured position to the released position;

(c) upon reaching the released position, the release mechanism releasing the actuator; and (d) actuating the downhole tool.

14. The method of claim 13, wherein, during step (b), the heating element causes greater expansion of the first connector as compared to an expansion of the second connector.

15. The method of claim 13, wherein during step (b), the heating element is activated by passing electrical current through the heating element.

16. A release mechanism for actuating a downhole tool, the release mechanism comprising:

a first connector having a first material, the first material having a first coefficient of thermal expansion;

a second connector having a second material, the second material having a second coefficient of thermal expansion, the second coefficient of thermal expansion being different from the first coefficient of thermal expansion, and the second connector being releasably connected to the first connector;

a heating element operatively associated with at least one of the first material or the second material; and a power source operatively associated with the heating element, wherein the first connector and the second connector have a secured position relative to each other and a released position relative to each other, wherein activation of the heating element causes the first connector and the second connector to be move toward the released position, and wherein the heating element is disposed within the second connector surrounded by a potting material, and the first coefficient of thermal expansion is greater than the second coefficient of thermal expansion.

17. A downhole tool, comprising:

a release mechanism, the release mechanism having a first connector having a first material, the first material having a first coefficient of thermal expansion, a second connector having a second material, the second material having a second coefficient of thermal expansion, the second coefficient of thermal expansion being less than the first coefficient of thermal expansion, and the second connector being releasably connected to the first connector, wherein the first connector and the second connector have a secured position relative to each other and a released position relative to each other, and a heating element operatively associated with at least one of the first material or the second material, wherein activation of the heating element causes the first connector and the second connector to be move toward the released position;

an actuator operatively associated with the release mechanism, the actuator having a run-in position when the release mechanism is in the secured position and an actuated position when the release mechanism is in the released position; and a connector tension element securing a first end of the first connector to a first end of the second connector.

* * * * *